US009739501B2

(12) United States Patent
Klett et al.

(10) Patent No.: US 9,739,501 B2
(45) Date of Patent: Aug. 22, 2017

(54) AC INDUCTION FIELD HEATING OF GRAPHITE FOAM

(71) Applicant: UT-Battelle, LLC, Oak Ridge, TN (US)

(72) Inventors: James W. Klett, Knoxville, TN (US); Orlando Rios, Knoxville, TN (US); Roger Kisner, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 294 days.

(21) Appl. No.: 14/466,532

(22) Filed: Aug. 22, 2014

(65) Prior Publication Data

US 2016/0057814 A1 Feb. 25, 2016

(51) Int. Cl.

| | |
|---|---|
| ***F24H 1/18*** | (2006.01) |
| ***H05B 6/10*** | (2006.01) |
| ***F24H 1/00*** | (2006.01) |

(52) U.S. Cl.

CPC ..... *F24H 1/0018* (2013.01); *H05B 6/105* (2013.01)

(58) Field of Classification Search

CPC ..... H05B 6/105; H05B 6/10; F24H 1/0018
USPC ..... 219/643
See application file for complete search history.

(56) References Cited

U.S. PATENT DOCUMENTS 3,107,152 A 10/1963 Ford
3,116,392 A * 12/1963 Morey ..... H05B 6/108 219/628
3,411,123 A 11/1968 Kydd
3,980,496 A 9/1976 Ludwig et al.
4,803,370 A 2/1989 Eckles
5,061,835 A * 10/1991 Iguchi ..... H05B 6/108 219/630
5,140,118 A 8/1992 Catanese et al.
5,481,091 A * 1/1996 Grimm ..... B23K 13/02 156/274.2
6,033,506 A 3/2000 Klett et al.
6,217,800 B1 * 4/2001 Hayward ..... C04B 14/022 264/109
6,261,485 B1 7/2001 Klett et al.
6,387,343 B1 5/2002 Klett et al.

(Continued)

FOREIGN PATENT DOCUMENTS

CN 102494315 6/2012
CN 202719427 2/2013

OTHER PUBLICATIONS

Ambrell Precision Iduction Heating (URL: www.ambrell.com/PDFo/411-0169-10.pdf), p. 1. What is induction heating?, ¶ 1-3.*
Lin, Wamel et al., Review on graphite foam as a thermal material for heat exchangers, Department of Energy Sciences, Lund University, Sweden. Energy End-Use Efficiency Issues (EEE), World Renewable Energy Congress May 2011; p. 748-755.
Drummond, Kevin, Thermal Characterization of Graphitic Foams for Use in Thermal Storage Applications. Department of Mechanical Engineering, Russ College of Engineering and Technology. Dec. 2012; 105pp.

(Continued)

*Primary Examiner* — Dana Ross
*Assistant Examiner* — Kuangyue Chen
(74) *Attorney, Agent, or Firm* — Fox Rothschild LLP

(57) ABSTRACT

A magneto-energy apparatus includes an electromagnetic field source for generating a time-varying electromagnetic field. A graphite foam conductor is disposed within the electromagnetic field. The graphite foam when exposed to the time-varying electromagnetic field conducts an induced electric current, the electric current heating the graphite foam. An energy conversion device utilizes heat energy from the heated graphite foam to perform a heat energy consuming function. A device for heating a fluid and a method of converting energy are also disclosed.

30 Claims, 26 Drawing Sheets

(56) References Cited

U.S. PATENT DOCUMENTS

| | | | | |
|---|---|---|---|---|
| 6,654,549 | B1 | 11/2003 | Konishi | |
| 6,673,328 | B1 * | 1/2004 | Klett | C04B 38/00 423/445 R |
| 6,729,269 | B2 | 5/2004 | Ott et al. | |
| 7,018,093 | B2 * | 3/2006 | Park | G01K 15/00 340/653 |
| 7,070,755 | B2 | 7/2006 | Klett et al. | |
| 8,350,198 | B2 | 1/2013 | Belsh et al. | |
| 9,083,062 | B2 * | 7/2015 | Kumar | H01M 4/131 |
| 9,214,330 | B2 | 12/2015 | Kawakami et al. | |
| 2005/0095168 | A1 | 5/2005 | Centanni et al. | |
| 2010/0051607 | A1 | 3/2010 | Yang et al. | |
| 2012/0049239 | A1 | 3/2012 | Sung | |
| 2012/0107555 | A1 * | 5/2012 | Miller | B29C 33/3828 428/141 |
| 2014/0017159 | A1 | 1/2014 | Hsiao | |
| 2014/0291690 | A1 | 10/2014 | Yi et al. | |

OTHER PUBLICATIONS

Koppers, KFOAM Product Brochure. Jul. 20, 2014; Conductivity, Low Density, Property; retrieved from internet <URL: http://www.koppers.com/pages/kfoam>.

Klett, James et al. High thermal conductivity mesophase pitch-derived carbon foams: effect on precursor on structure and properties. Oak Ridge National Laboratory, Oak Ridge Tennesee, Carbon, vol. 38, Issue 7, 2000, 3 pgs.

Ambrell Precision Induction Heating, About Induction Heating, Jun. 14, 2014, retrieved from internet, <URL:www.ambrell.com/PDFo/411-0169-10.pdf>.

The International Search Report and the Written Opinion of the International Searching Authority, mailed Nov. 24, 2015, pp. 1-11.

International Search Report and The Written Opinion of the International Searching Authority for PCT/US15/45636 , dated Jan. 6, 2016, pp. 1-18.

* cited by examiner

AC INDUCTION FIELD HEATING OF GRAPHITE FOAM

STATEMENT REGARDING FEDERALLY SPONSORED RESEARCH

This invention was made with government support under contract No. DE-AC05-00OR22725 awarded by the U.S. Department of Energy. The government has certain rights in this invention.

FIELD OF THE INVENTION

This invention relates generally to heating methods and devices, and more particularly to heating methods and devices incorporating carbon foams.

BACKGROUND OF THE INVENTION

Carbon foams are known to have many desirable properties. These properties include high thermal conductivity, and a very high specific thermal conductivity which can be 4 times that of copper. Examples of such foams and of methods to prepare such foams can be found in U.S. Pat. No. 6,033,506, U.S. Pat. No. 6,261,485, U.S. Pat. No. 6,387,343, and U.S. Pat. No. 6,673,328, the disclosures of which are hereby incorporated fully by reference.

SUMMARY OF THE INVENTION

A magneto-energy apparatus includes an electromagnetic field source for generating a time-varying electromagnetic field. A graphite foam conductor is disposed within the electromagnetic field. The graphite foam when exposed to the time-varying electromagnetic field conducts an induced electric current, the electric current heating the graphite foam. An energy conversion device utilizes heat energy from the heated graphite foam to perform a heat energy consuming function.

The graphite foam can have a thermal conductivity of at least 40 W/mK. The graphite foam can have a thermal conductivity of between 40-100 W/mK. The graphite foam can have a thermal conductivity of at least 220 W/mK. The graphite foam can have a thermal conductivity of between 220-240 W/mK.

The specific thermal conductivity of the graphite foam can be at least 109 W $cm^3$/mKg. The specific thermal conductivity of the graphite foam can be between 109-200 W $cm^3$/mKg. The graphite foam can have a specific thermal conductivity greater than four times that of copper.

The graphite foam can have a porosity of at least 69%. The graphite foam can have a porosity of at least 85%. The graphite foam can have a porosity of between 69%-85%.

The time varying electromagnetic field can have a frequency of between 25 kHz-1 MHz. The time varying electromagnetic field can have a frequency of at least 180 kHz. The time varying electromagnetic field can have a frequency of less than 10 MHz. The time varying electromagnetic field can have a frequency of less than 2 MHz.

The time varying electromagnetic field can have a power of at least 1 kW. The time varying electromagnetic field can have a power of between 10 W-20 kW.

The graphite foam can be derived from a pitch selected from the group consisting of petroleum-derived mesophase pitch, petroleum derived isotropic pitch, coal-tar-derived mesophase pitch, synthetic mesophase pitch, and synthetic isotropic pitch.

The graphite foam can have an X-ray diffraction pattern as depicted in FIG. 20. The graphite foam can have an X-ray diffraction pattern exhibiting doublet peaks at 2θ angles between 40 and 50 degrees.

The energy conversion device can be a water heater. The graphite foam is within an electrically non-conductive housing.

A device for heating a fluid includes an electromagnetic field source for generating a time-varying electromagnetic field. A graphite foam conductor is disposed within the electromagnetic field. The graphite foam when exposed to the time-varying electromagnetic field conducts an induced electric current. The electric current heats the graphite foam. At least one fluid flow path is provided for contacting the fluid with the graphite foam, whereby the heated graphite foam will transfer heat to the fluid. The fluid can be water. The device can further include a switch for selectively energizing the electromagnetic field source. The device can include at least one temperature sensor. The temperature sensor operates to turn on the electromagnetic field source when the temperature of the fluid is below a set point, and to turn off the electromagnetic field source when the temperature of the fluid is above a set point.

A method of converting energy includes the steps of: a) providing an electromagnetic field source for generating a time-varying electromagnetic field; b) providing a graphite foam conductor disposed within the electromagnetic field, the graphite foam when exposed to the time-varying electromagnetic field conducting an induced electric current, the electric current heating the graphite foam; and c) providing an energy conversion device and utilizing heat energy from the heated graphite foam to perform a heat energy consuming function. The graphite foam can be heated to between 600-1000° C. in 15 seconds.

The energy conversion step can be heating a substance. The substance can be a fluid. The fluid can be water.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

A magneto-energy apparatus includes an electromagnetic field source for generating a time-varying electromagnetic field. A graphite foam conductor is disposed within the electromagnetic field. The graphite foam when exposed to the time-varying electromagnetic field conducts an induced electric current, the electric current heating the graphite foam. An energy conversion device utilizes heat energy from the heated graphite foam to perform a heat energy consuming function.

The manner in which the electromagnetic field is applied to the graphite foam can vary. The source should be placed in such proximity to the graphite foam that the electromagnetic field sufficiently cuts through the foam to generate a sufficient induced current to satisfy the heating requirements of the particular application. It has been found that an efficient arrangement for positioning the source about the graphite foam is to wrap conductive coils of the source about the graphite foam, and particularly about a non-conductive housing that surrounds the foam. The energy conversion device can be a water heater. The graphite foam can be provided within an electrically non-conductive housing.

Figure 1:
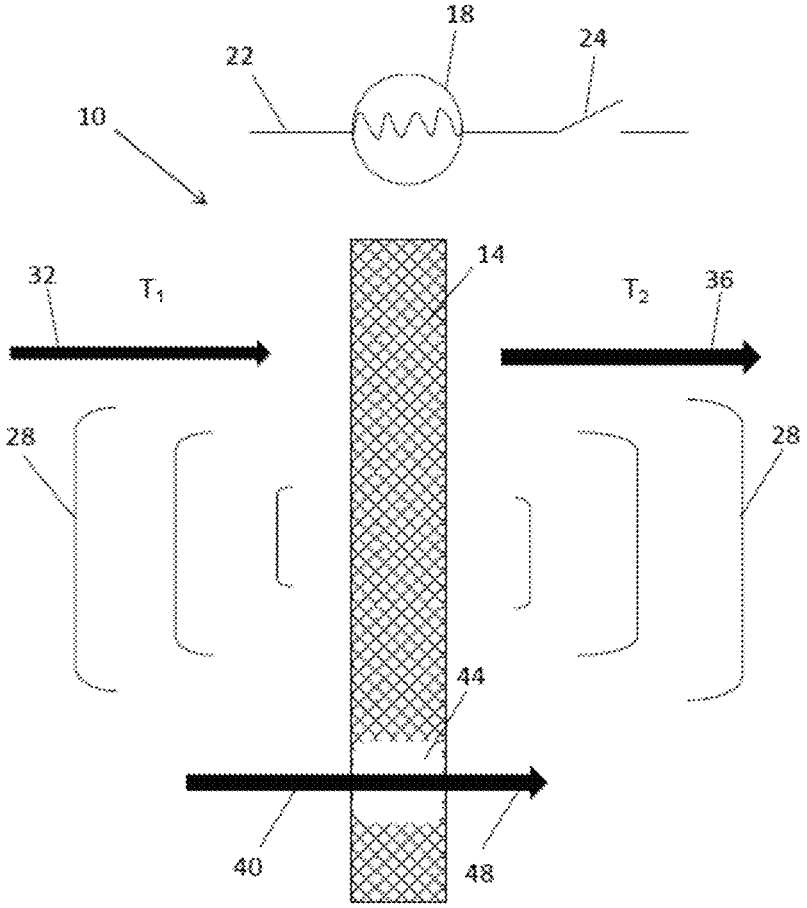
FIG. 1 is a schematic diagram of a magneto-energy apparatus according to the invention.

An example of a magneto-energy apparatus is shown in FIG. 1. A device 10 for heating a fluid includes an electromagnetic field source 18 for generating a time-varying electromagnetic field 28. The electromagnetic field source can be powered through a suitable circuit 22 and can have a switch 24 for selectively applying the electromagnetic field to the graphite foam. The switch 24 can be manually operated or can be electrically operated as by a solenoid and controlled by a programmable controller or computer processor. A graphite foam conductor 14 is disposed within the electromagnetic field 28. The graphite foam 14 when exposed to the time-varying electromagnetic field conducts an induced electric current. The electric current heats the graphite foam 14. At least one fluid flow path 32 is provided for contacting the fluid with the graphite foam 14, whereby the heated graphite foam 14 will transfer heat to the fluid 32 leaving the graphite foam 14, and the temperature of the fluid will be raised from $T_1$ for fluid 32 prior to contact with the graphite foam 14 to a temperature $T_2$ for fluid 36 exiting the device.

The invention when used to heat objects and materials can be used to heat fluids flowing over or through the graphite foam. The fluid can be water. Other fluids including other liquids, gases, and mixtures of both can be heated by the invention.

The pores of the porous graphite foam will permit the passage of fluids such as liquids and gases. Flow channels through the graphite foam can be provided where increased flow rates and/or reduced pressure drops are desired. The size, number and position of such flow channels can be varied depending on the application. The flow channels can be straight or curved or fitted with baffles to increase heat transfer interaction with the graphite foam as the fluid passes through the channels. A flow channel 44 is provided in graphite foam 14 as shown in FIG. 1. The liquid 40 flows into the channel 44 at temperature $T_1$, is heated by the graphite foam, and liquid 48 exits the flow channel at temperature $T_2$.

Figure 2:
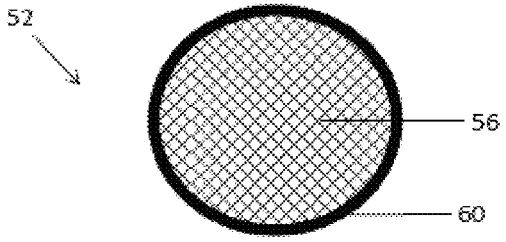
FIGS. 2(*a-c*) is a schematic diagram of an apparatus for heating a fluid with a core of a) porous graphite foam; b) graphite foam with a central fluid flow channel; and c) graphite foam with a plurality of fluid flow channels.
Figure 2:
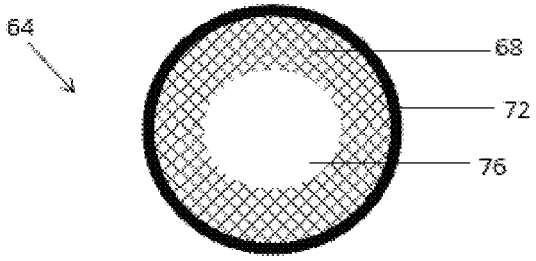
Figure 2:
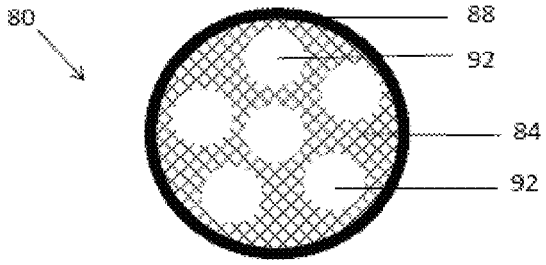

In one embodiment the graphite foam can be positioned within a non-conductive housing. Such a construction 52 is shown in FIG. 2(*a*). The non-conductive housing 60 provides an enclosure for the graphite foam 56 and also can contain the flow of fluid flowing through the porous graphite foam 56. There is shown in FIG. 2(*b*) a device 64 having graphite foam 68 within an enclosure 72. The graphite foam 68 has an interior large diameter flow channel 76 to heat a fluid flowing therein at a significant flow rate and with an acceptable pressure drop. There is shown in FIG. 2(*c*) a device 80 having graphite foam 84 within enclosure 88. A plurality of flow channels 92 are provided in the graphite foam 84 to provide significant heating contact between the graphite foam and fluid flowing within the channels 92. The electromagnetic field can be applied by a conductive coil wrapped around the enclosure, or by some other field-generating device.

Many shapes and sizes of enclosures can be utilized. In one embodiment the enclosure can be tubular. Any suitable non-conducting enclosure material can be used. In one embodiment, the enclosure can be polyvinyl chloride (PVC).

Figure 3:
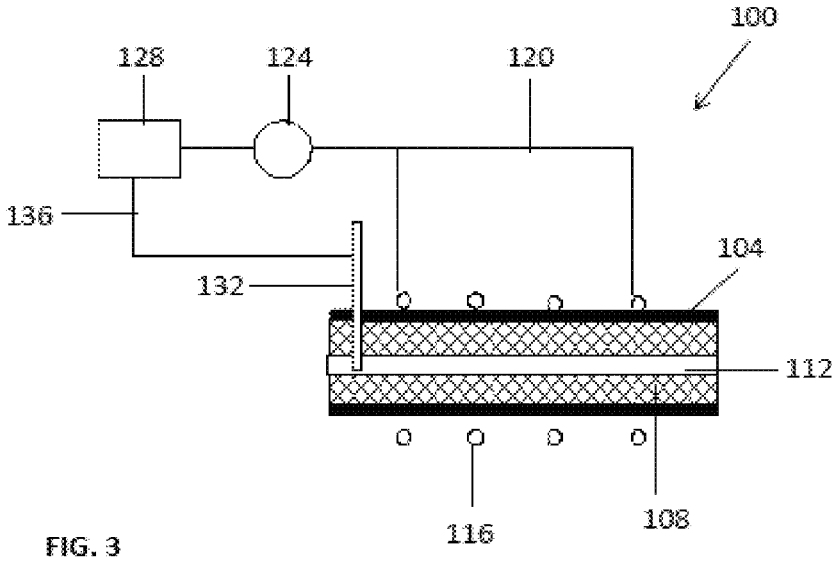
FIG. 3 is a schematic diagram of a water heating apparatus according to the invention.

There is shown in FIG. 3 a device 100 having an enclosure 104 containing graphite foam 108. The graphite foam 108 can have one or more suitable flow channels 112. An electromagnetic field can be applied to the foam by suitable structure such as conducting coil 116. The coil 116 can be connected to a circuit 120 that is energized by AC source 124. A processor 128 can act to control the AC source as by appropriate switching and opening and closing of the circuit 120. The processor 128 can act to supply energy to activate the heating of the graphite foam 108 according to any suitable procedure, protocol or processor, such as by a timed protocol or in response to a control signal from another device. A temperature sensor 132 can be provided at an exit end of the flow channel 112 to determine the temperature of fluid exiting the flow channel 112. The sensor 132 can send a signal though signal line 136 which can be wired or wireless to the processor 128 to adjust the power level or frequency of the AC current, heating cycle times, on/off, or other characteristics of the energy reaching the device to control the heating of the graphite foam 108 and thus the fluid responsive to the exiting temperature.

The graphite foam can have a thermal conductivity of at least 40 W/mK. The graphite foam can have a thermal conductivity of between 40-100 W/mK. The graphite foam can have a thermal conductivity of at least 220 W/mK. The graphite foam can have a thermal conductivity of between 220-240 W/mK.

The specific thermal conductivity of the graphite foam can be at least 109 W $cm^3$/mKg. The specific thermal conductivity of the graphite foam can be between 109-200 W $cm^3$/mKg. The graphite foam can have a specific thermal conductivity greater than four times that of copper.

The graphite foam can have a porosity of at least 69%. The graphite foam can have a porosity of at least 85%. The graphite foam can have a porosity of between 69%-85%. The porosity can be as high as 89% and as low as 67%. The foam can have interconnected or isolated cells (pores). Interconnected pores allow fluid and gases to pass though the foam and allow the fluid or gas to access the high surface area of the foam. This leads to efficient transfer of thermal energy between the foam and media.

The time varying electromagnetic field can have any suitable frequency. In one aspect, the time varying electromagnetic field has a frequency of between 25 kHz-1 MHz. The time varying electromagnetic field can have a frequency of at least 180 kHz. The time varying electromagnetic field can have a frequency of less than 10 MHz. The time varying electromagnetic field can have a frequency of less than 2 MHz. The foam is an integral part of the resonant circuit. The power supply runs on a resonant circuit LC (inductor capacitor) or LCR (inductor capacitor resistor) also known as a tank circuit. The foam adds inductance to the working induction coil.

The time varying electromagnetic field can have any suitable power level. In one aspect, the time varying electromagnetic field has a power of at least 1 kW. The time varying electromagnetic field can have a power of between 10 W-20 kW. Some applications will require power of between 1-5 kW, or 1-10 kW, or 1-20 kW. Some applications will require lower power levels, for example 10-500 W or 10-1 kW. A power greater than 5 kW can be used where faster heating rates and higher temperatures are desired.

A method of converting energy includes the steps of: a) providing an electromagnetic field source for generating a time-varying electromagnetic field; b) providing a graphite foam conductor disposed within the electromagnetic field, the graphite foam when exposed to the time-varying electromagnetic field conducting an induced electric current, the electric current heating the graphite foam; and, c) providing an energy conversion device and utilizing heat energy from the heated graphite foam to perform a heat energy consuming function. The energy consuming function can be heating a substance. The substance can be a fluid. The fluid can be water.

The use of an AC induction field to heat a section of graphite foam provides for an efficient instant on water heaters. A section of the foam can be provided in a non-conductive enclosure such as a plastic tube, and AC induction coil can be wrapped around the section. The electronics for this is well known, such as for HOB's on stoves. The electronics would detect flow and the AC field would heat the foam to the proper set point temperature (with feed back control) within seconds. A sensor would detect flowing water and nearly instantly heat the foam hot enough to heat the water to proper temperature for use in the home. This would be a very small system, and relatively inexpensive. The invention can be used for other heat-consuming functions such as, without limitation, hot water dispensers like a single coffee cup or hot cocoa maker. This could be used at the source of sinks in commercial buildings, and wherever rapid supplies of hot water are required.

In addition, for manufacturing systems that cycle hot objects such as injection molding, composite tooling, and the like. The core of the device could be foam with an internal AC induction coil. At times that the system needs to be hot, the power is energized and the foam will heat extremely fast. When the system needs to be cooled, the power is turned off, and air or another cooling fluid is passed through the pores of the foam to cool the system. This will allow devices to cycle much faster and improve throughput and reduce costs per part.

The graphite foam can be derived from any suitable carbonaceous starting material and can be prepared by any suitable process. In one aspect the carbon foam is prepared from a pitch selected from the group consisting of petroleum-derived mesophase pitch, petroleum derived isotropic pitch, coal-tar-derived mesophase pitch, synthetic mesophase pitch, and synthetic isotropic pitch.

Experiment

Two different foams in two different geometries were evaluated. A more open cellular graphite foam was used to minimize the potential pressure drop of the foam. A higher thermal conductivity foam (but smaller cell size) was used to determine if thermal conductivity is important to the efficiency of the heat transfer to the water. Structures were created to reduce the pressure drop, so that instead of having a single solid piece of foam in the tube that the water must pass through, foam drilled with many holes was used to allow water to flow completely through the foam. Other methods such as corrugations can be used.

The term P1 was given to the type of pitch used to make all three foams and the term HD was used for High-Density foams. These were foams made at 1000 psi versus 400 psi and which result in smaller, high density foam cells. Therefore P1 HD represents P1 foam made at 1000 psi and P1 represents foam made at 400 psi. In addition, when an additive was used with the pitch to adjust the pore size it was represented by the percentage of the additive and the name of the additive. Hence, P1 HD+10% Graphite is P1 foam made with 10% graphite powder by weight and foamed at 1000 psi. Table 1 below details the foams made under this project.

TABLE 1

Foams used in this project.

| ID | Pitch | Foaming Pressure | Additive |
|---|---|---|---|
| P1 | P1 | 400 psi | n/a |
| P1 HD | P1 | 1000 psi | n/a |
| P1 HD + 10% Graphite | P1 | 1000 psi | 10% graphite |

A copper coil was used as an induction coil to heat the foam. As the magnetic field moves the electrons within the graphite, the movement produces heat. A PVC pipe placed between the coil and the foam does not heat because the PVC is not an electrically conductive material. Therefore, the induction field created by the induction coil passes freely through the PVC pipe without resulting in any electrical flow in the PVC material. Other non-conducting materials could be utilized. The graphite foam is an electrical conductor, and high-frequency induction fields induce electrical currents that dissipate electrical energy, resulting in heating.

Equipment

Each foam piece was inserted into the PVC pipe and then rubber stoppers and caps were placed on each end. The caps and rubber stoppers then fit over copper pipes on each end of the PVC pipe and screwed on tightly for a water-tight seal. Quarter-inch copper tubing was used to make three different size coils: a single-turn coil, three-turn coil, and six-turn coil. It was anticipated that the different number of coils would couple differently with the foam, thus changing the efficiency. Each coil was wrapped around a different PVC pipe. The coils were then connected to the power unit through a power cord.

Flow rate was measured by a rotameter and thermocouples were placed in the water stream before and after the foam in order to measure the temperature change of the water after passing through the graphite foam energized by the induction heating. Pressure taps next to the thermocouple locations were connected to pressure transducers to measure the pressure drop across the foam at different flow rates.

Testing

Once the foam was inserted into the PVC pipe and fitted to the system, the pipe was attached to the copper pipes and the coil was attached to the power source. After checking the fit into the apparatus, the water pump was turned on slightly to search for any leaks. After a successful leak check, each piece of foam was tested at four different flow rates (2, 3, 4, and 5 gallons per minute), five different power levels (1, 2, 3, 4, and 5 kilowatts), two frequencies (25 kHz and 180 kHz), and with three different size coils (single turn, three turn, and six turn).

Low Frequency (25 kHz)

A low-frequency power source was tested first. The water flow was initiated and then the power was set to the correct level on the controller and engaged. The temperature change was monitored and, after the water had reached a stable temperature, the power was turned off. The next power level was set on the controller. The induction current was engaged and this was repeated for each power level. After each power level was tested, the power was set back to the low level and the flow rate changed. In this manner, all the flow rates and power levels were tested for each foam. The low-frequency power source was found to be very inefficient as it only produced an average maximum of 1.5° C. change in water temperature at the maximum power level.

High Frequency (180 kHz)

A high-frequency power source was then used. Each foam was tested at all four flow rates with all five power levels and in all three different coils. The single-turn and three-turn coils did not perform very efficiently, however there was success with the six-turn coil. The 400 PSI foam coupled with the 6 turn coil had an average minimum temperature change of 0.6° C. at 5 gallons/minute with 1 kilowatt of power and an average maximum temperature change of 6.7° C. at 2 gallons/minute with 5 kilowatts of power.

Examples of temperature change for the P1 graphite foam and varying flow rates and power levels is shown in Table 2 below.

TABLE 2

Average Change In Temperature for the P1 Foam

| | 1 KW ° C. | 2 KW ° C. | 3 KW ° C. | 4 KW ° C. | 5 KW ° C. |
|---|---|---|---|---|---|
| 2 GPM | 1.719 | 3.00 | 4.320 | 5.746 | 6.655 |
| 3 GPM | 1.385 | 2.097 | 2.564 | 3.459 | 4.372 |
| 4 GPM | .839 | 1.668 | 2.198 | 2.586 | 3.211 |
| 5 GPM | .638 | 1.078 | 1.591 | 1.941 | 2.477 |

Figure 4:
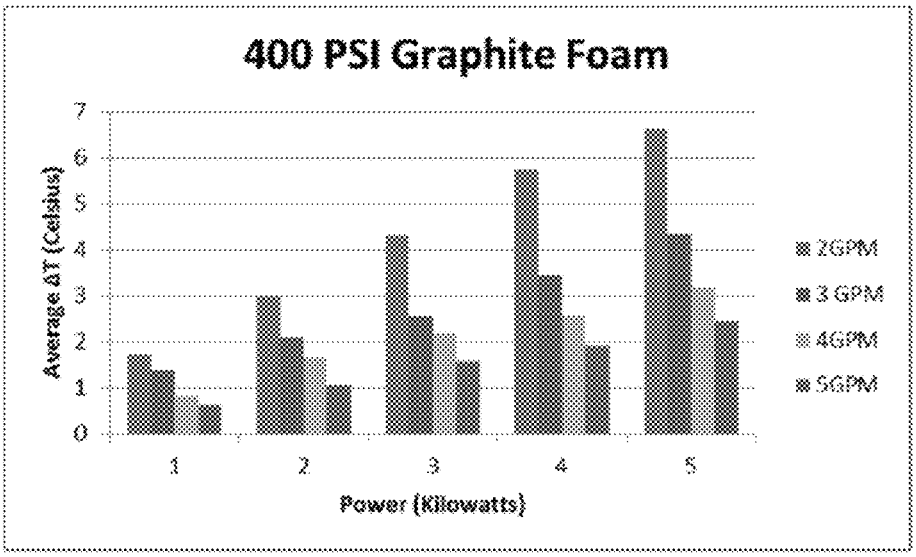
FIG. 4 is a plot of temperature change as a function of power and flow rate for P1 graphite foams.
Figure 5:
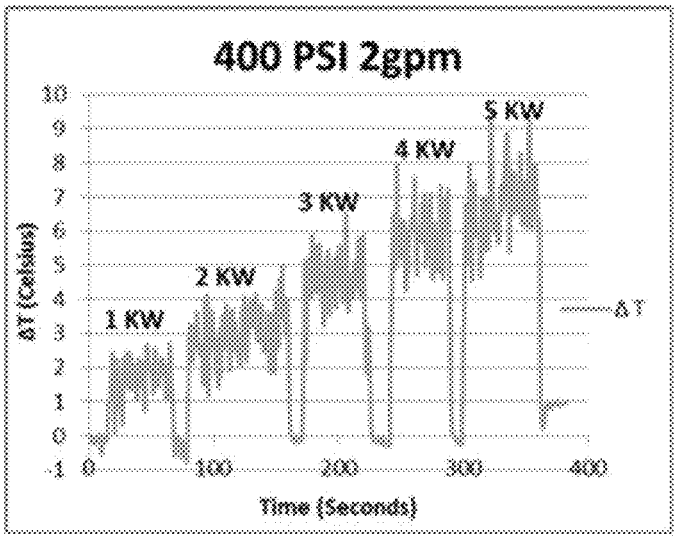
FIG. 5 is a plot of temperature change as a function of time for 400 PSI foams for water flowing at 2 gpm and applied power of 1 kW, 2 kW, 3 kW, 4 kW, and 5 kW.
Figure 6:
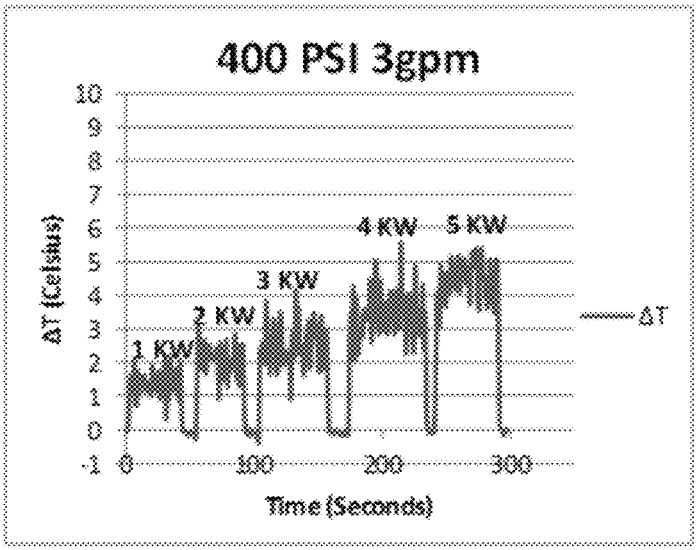
FIG. 6 is a plot of temperature change as a function of time for 400 PSI foams for water flowing at 3 gpm and applied power at 1 kW, 2 kW, 3 kW, 4 kW, and 5 kW
Figure 7:
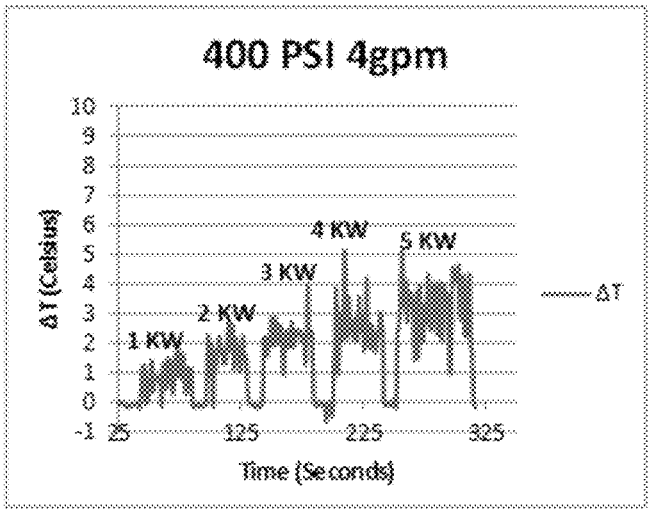
FIG. 7 is a plot of temperature change as a function of time for 400 PSI foams for water flowing at 4 gpm and applied power of 1 kW, 2 kW, 3 kW, 4 kW, and 5 kW
Figure 8:
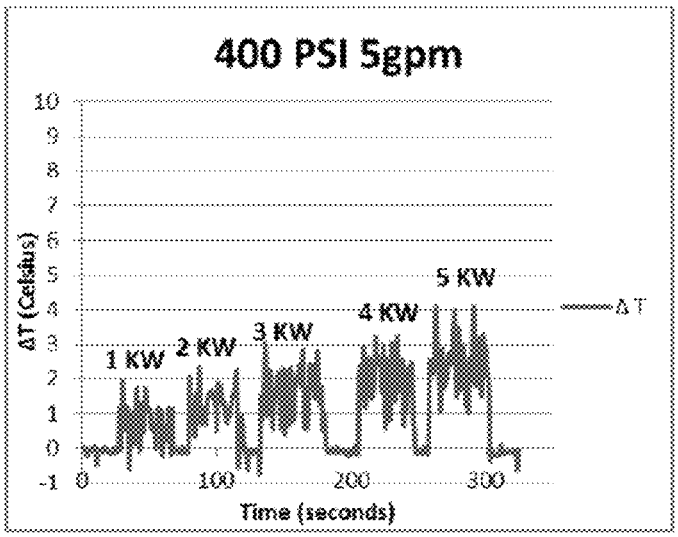
FIG. 8 is a plot of temperature change as a function of time for 400 PSI foams for water flowing at 2 gpm and applied power of 1 kW, 2 kW, 3 kW, 4 kW, and 5 kW

The results are plotted in FIG. 4, and illustrate the impact of applied power and increasing flow rate, which decreases contact heating time between the water and the foam. FIGS. 5-8 plot the change in temperature with time and at constant flow rate, but with increasing power levels. Power levels have a direct effect on temperature change, and it can also be see that temperature change is quite rapid when the power is applied. Flow rate also significantly impacts the temperature change as can be seen in a comparison of FIG. 5 (2 gpm), FIG. 6 (3 gpm), FIG. 7 (34 gpm) and FIG. 8 (5 gpm). The rotameter used for these experiments could have deviation of as much as 0.5 gallon/minute, which could affect the change in temperature. Also, the amount of power supplied by the power source could vary by as much as 0.25 kilowatts.

Examples of temperature change for the P1 HD foam+ 10% graphite powder at varying flow rates and power levels is shown in Table 3 below.

TABLE 3

Average Change in Temperature for P1 HD + 10% Graphite Foam

| | 1 KW ° C. | 2 KW ° C. | 3 KW ° C. | 4 KW ° C. | 5 KW ° C. |
|---|---|---|---|---|---|
| 2 gpm | 1.714 | 2.813 | 3.626 | 4.652 | 5.962 |
| 3 gpm | .863 | 1.448 | 2.210 | 2.497 | 3.400 |
| 4 gpm | .751 | 1.307 | 1.574 | 2.183 | 2.734 |
| 5 gpm | .556 | .972 | 1.220 | 1.772 | 2.435 |

Figure 9:
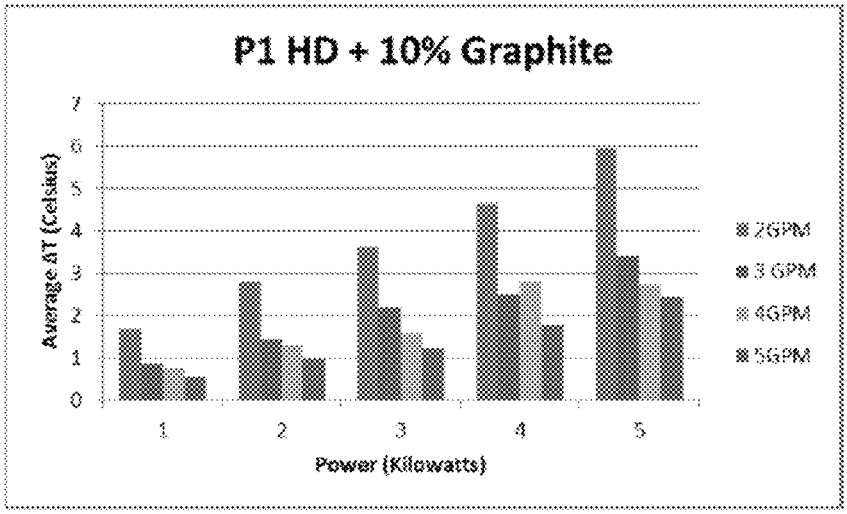
FIG. 9 is a plot of temperature change as a function of power and flow rate for P1 HD+10% graphite foams.

These results are plotted in FIG. 9.

Examples of temperature change for the P1 HD graphite foam at varying flow rates and power levels is shown in Table 4 below.

TABLE 4

| Average Change in Temperature for P1 HD foam | | | | | |
|---|---|---|---|---|---|
| | 1 KW ° C. | 2 KW ° C. | 3 KW ° C. | 4 KW ° C. | 5 KW ° C. |
| 2 gpm | .943 | 2.055 | 2.048 | 3.520 | 3.112 |
| 3 gpm | 1.082 | 1.830 | 2.428 | 2.732 | 3.366 |
| 4 gpm | .818 | 1.407 | 1.745 | 2.168 | 2.490 |
| 5 gpm | .551 | .888 | 1.234 | 1.718 | 1.774 |

Figure 10:
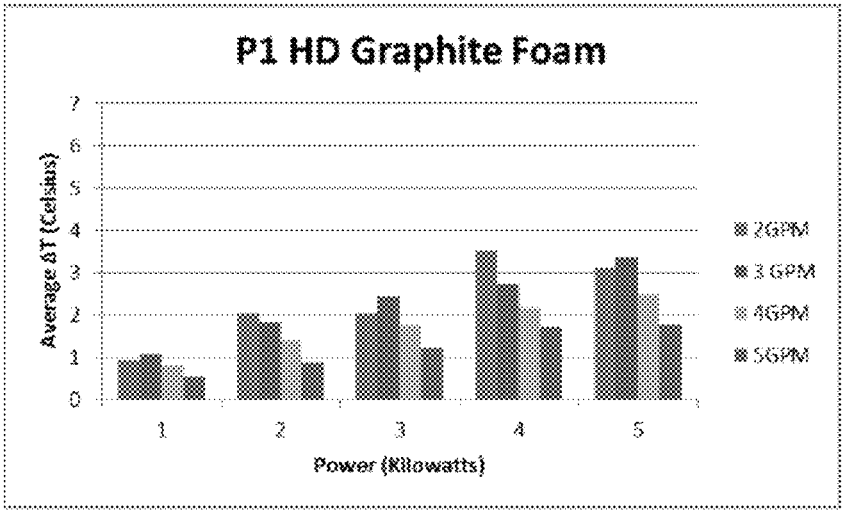
FIG. 10 is a plot of temperature change as a function of power and flow rate for P1 HD graphite foam.
Figure 11:
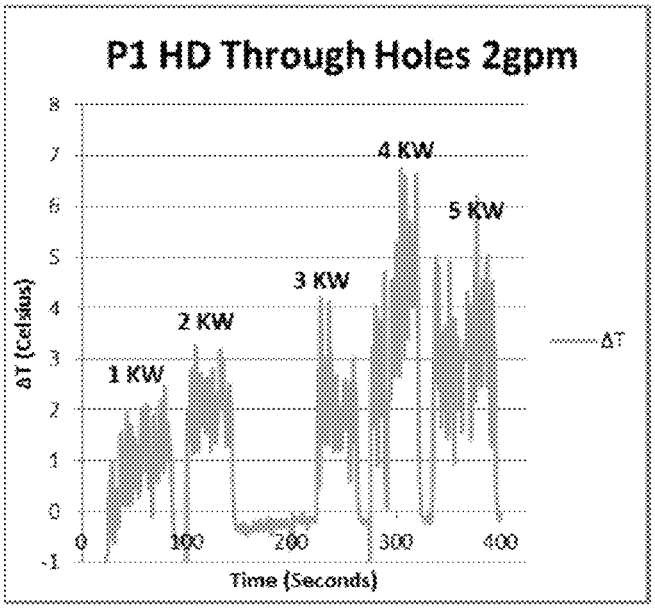
FIG. 11 is a plot of temperature change as a function of time for P1 HD foams for water flowing through holes at 2 gpm and applied power at 1 kW, 2 kW, 3 kW, 4 kW, and 5 kW.
Figure 12:
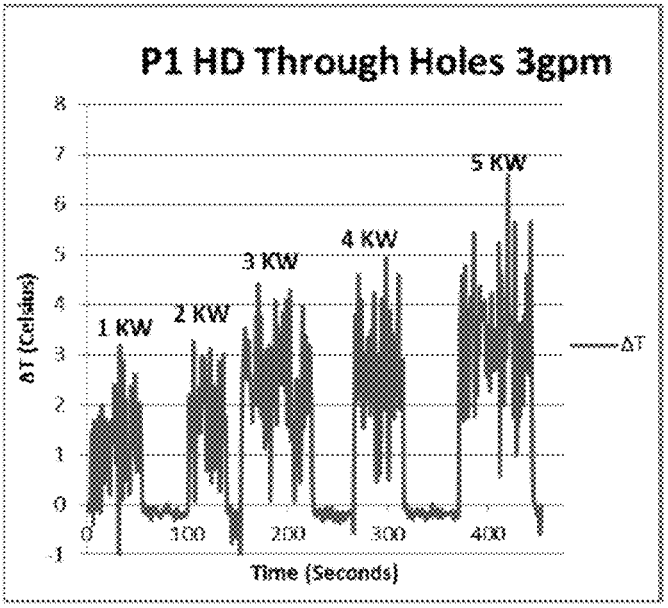
FIG. 12 is a plot of temperature change as a function of time for P1 HD foams for water flowing through holes at 3 gpm and applied power at 1 kW, 2 kW, 3 kW, 4 kW, and 5 kW.
Figure 13:
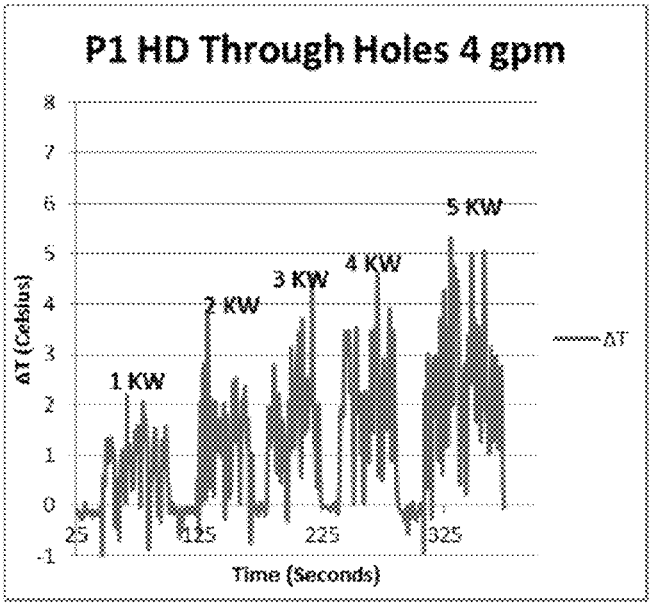
FIG. 13 is a plot of temperature change as a function of time for P1 HD foams for water flowing through holes at 4 gpm and applied power at 1 kW, 2 kW, 3 kW, 4 kW, and 5 kW.
Figure 14:
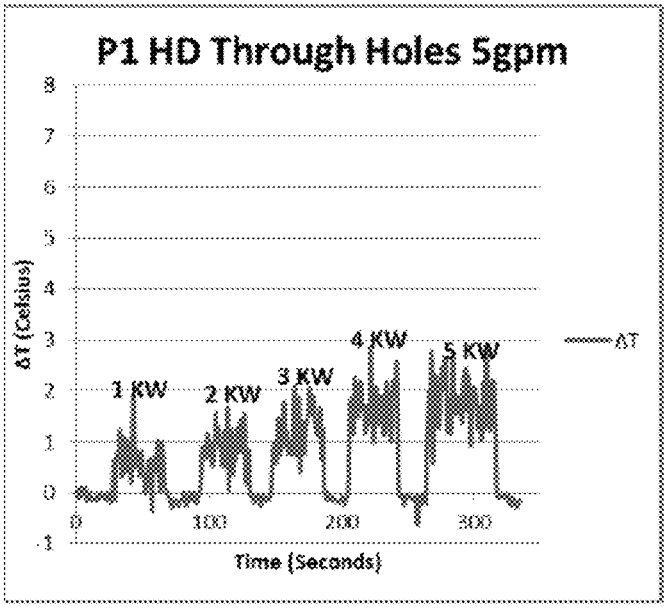
FIG. 14 is a plot of temperature change as a function of time for P1 HD foams for water flowing through holes at 5 gpm and applied power at 1 kW, 2 kW, 3 kW, 4 kW, and 5 kW.

These results are also plotted in FIG. 10. FIGS. 11-14 plot the change in temperature with time and at constant flow rate for P1 HD with 25 through holes, but with increasing power levels. Power levels have a direct effect on temperature change, and it can also be see that temperature change is quite rapid when the power is applied. Flow rate also significantly impacts the temperature change as can be seen in a comparison of FIG. 11 (2 gpm), FIG. 12 (3 gpm), FIG. 13 (34 gpm) and FIG. 14 (5 gpm).

Figure 15:
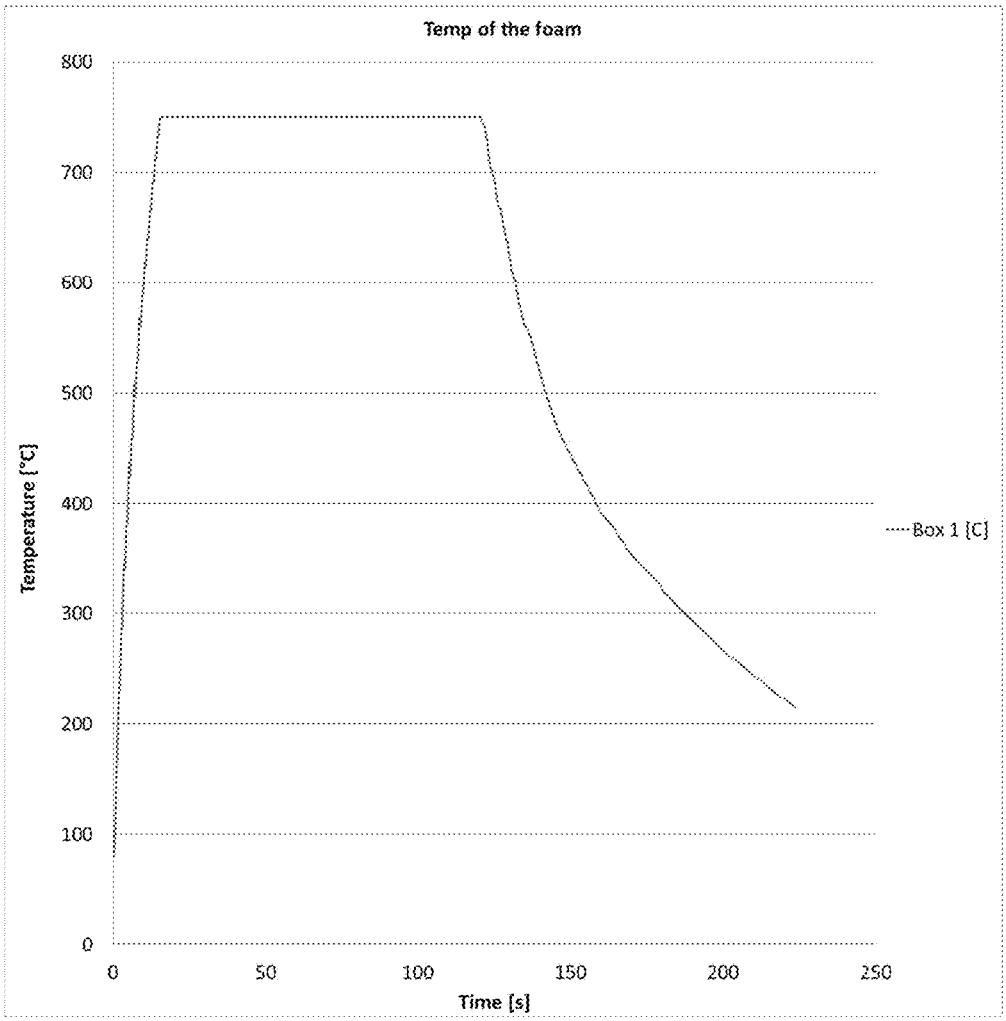
FIG. 15 is a plot of temperature versus time for a graphite foam in a magneto-energy apparatus.
Figure 16:
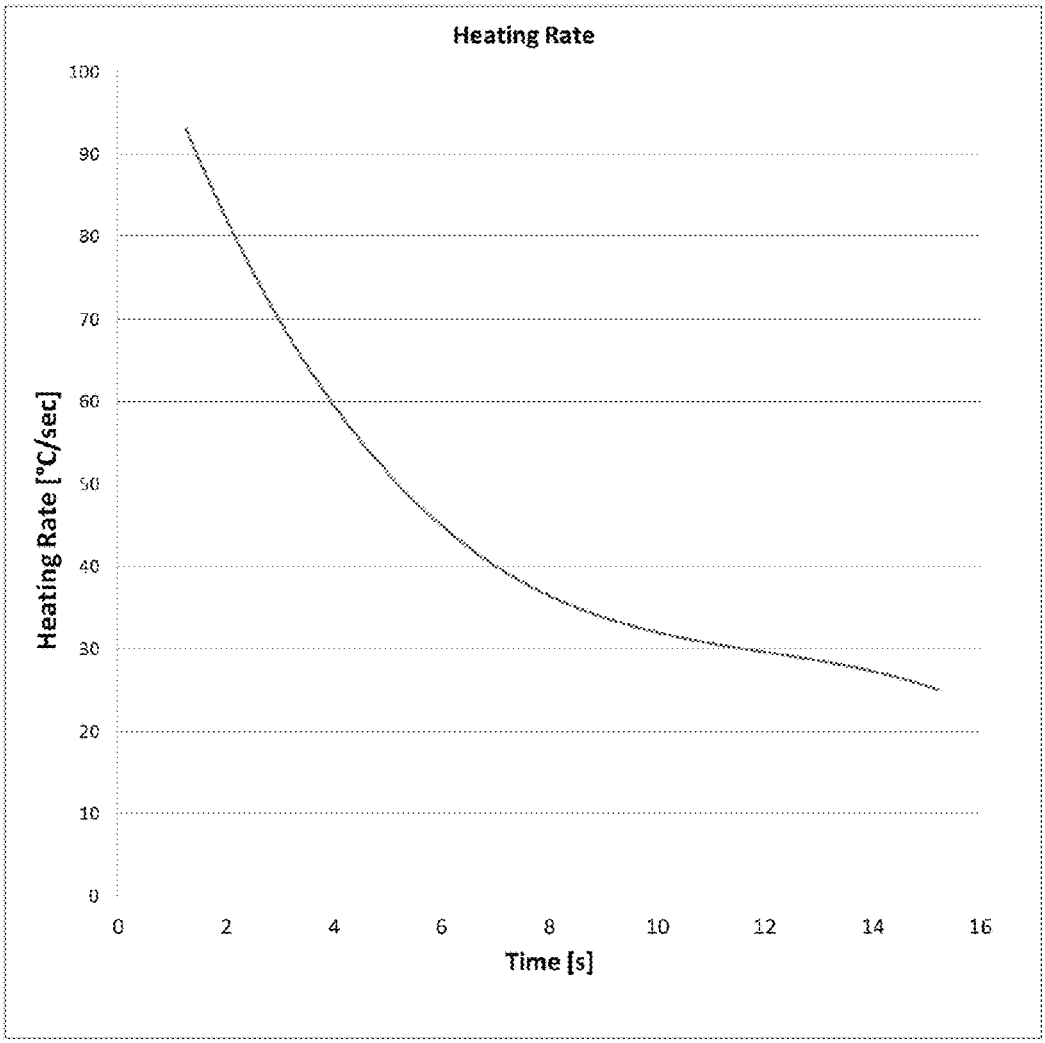
FIG. 16 is a plot of heating rate (° C./s) versus time (s) for a graphite foam in a magneto-energy apparatus.
Figure 17:
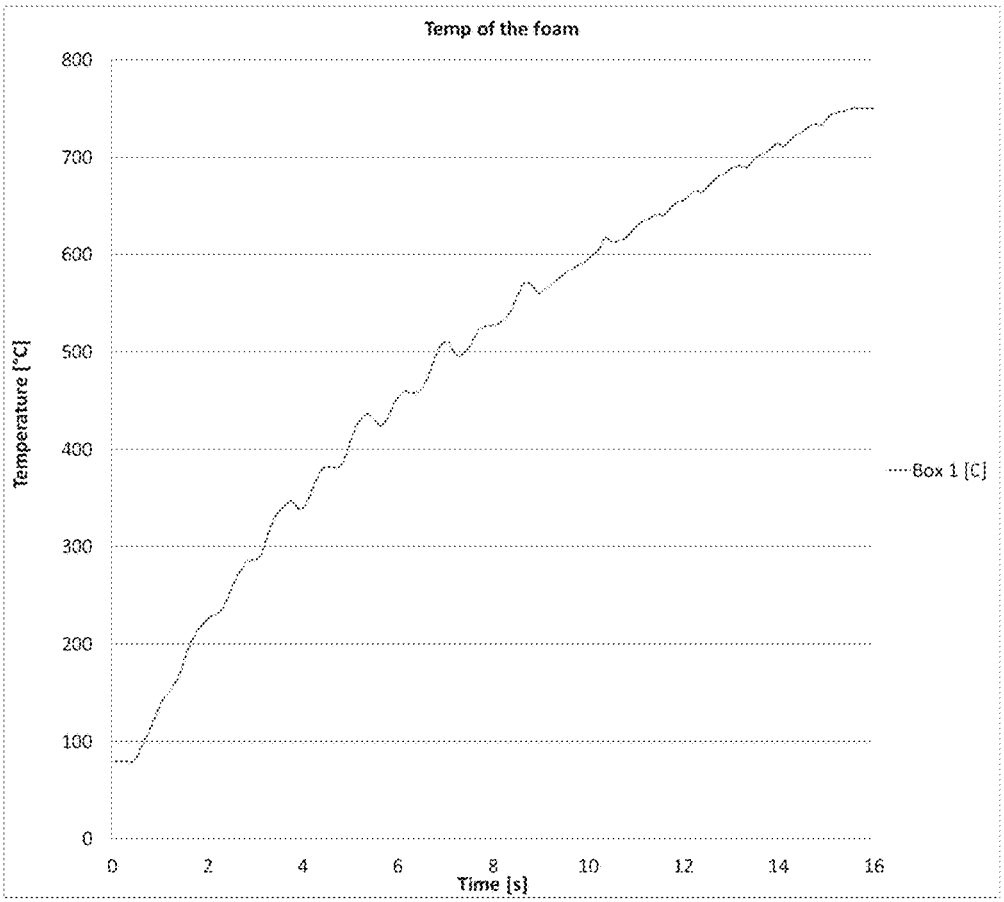
FIG. 17 is a plot of temperature (° C.) versus time (s) for a graphite foam in a magneto-energy apparatus.
Figure 18:
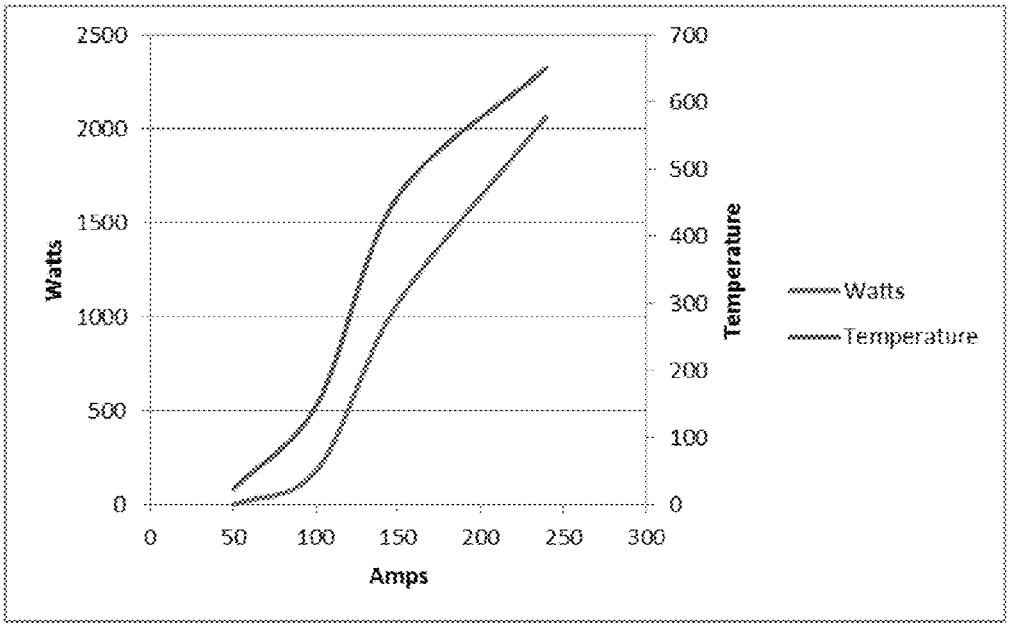
FIG. 18 is a plot power and temperature as a function of applied amperage.

FIG. 15 illustrates the very fast temperature ramp rate once the power is applied. FIG. 16 illustrates the cyclic nature of the heating rate with time. FIG. 17 illustrates the fast ramp rates and temperatures attained by the graphite foam. FIG. 18 shows the close relationship between the applied amperage and the resulting graphite foam power and temperature. FIG. 17 shows the heating rate of a 1" diameter block of foam by 3" long in an induction field. FIG. 18 shows the relationship between power applied and the temperature of the foam after heating.

On average, the P1 foam produced the largest change in overall temperature. However the P1 HD+10% graphite foam also produced favorable changes in temperatures. The P1 HD foam produced the lowest overall temperature change. On average, water at room temperature is approximately 20° C. and the temperature used to take a shower is approximately 40° C., a 20° C. change in temperature. While the results only showed a 6.5° C. change, commercial units also use three times the amount of power used in this experiment to heat the water. The induction of the graphite foam results in a nearly instantaneous change in water temperature, less than 2 seconds as shown in FIG. 15, which is very useful for water heating applications and could result in water conservation.

The results indicate that the number of turns of the coil can significantly affect performance of the device. A doubling of the number of turns on the coil from three to six doubled the temperature for the P1 HD+10% graphite. It can be projected that subsequent increases in the number of turns would, to a point, have a similar effect. The results were also affected by the amount of power supplied to the coils. A typical tank less water heater uses about 14-18 kilowatts of power. For the experiments a maximum of 5 kW of power was supplied. Since there was a proportional increase in the change in temperature as the power increased, increasing the power supplied to the coils will increase in the change in temperature as well. The relationship between applied power and temperature of the foam is shown in Table 5 and FIG. 18.

TABLE 5

| Induction heating of carbon foam | | | |
|---|---|---|---|
| Amps | Watts | Temp C. | Freq kHz |
| 0 | 0 | 24 | 0 |
| 50.4 | 187 | 150 | 181 |

TABLE 5-continued

| Induction heating of carbon foam | | | |
|---|---|---|---|
| Amps | Watts | Temp C. | Freq kHz |
| 100.8 | 1071 | 460 | 177 |
| 150 | 2063 | 650 | 180 |
| 239.4 | 4323 | 800 | 181 |

The graphite foam is very receptive to an AC induction field. A sample of the foam was placed in an AC induction field and heated to over 600° C. (glowing red hot), or to 600-1000° C., within 15 seconds. The invention has application to many types of heating techniques and devices. The graphite foam heats faster than other carbon structures such as the blocks of graphite typically used as a susceptor, as well as carbon fibers. Typical graphite skin penetration is about 11 mm @ ~180 kHz (for an 8000 micro-ohm-cm resistivity material), although this will vary with frequency and power. Skin depth is a strong function of frequency but not of power. The total intensity is a function of power however the distribution of Eddy currents across the surface is not strongly related to power. Heating takes place within the shallow region defined by the skin depth. A one e-fold depth (which captures about 64 percent of the energy) in graphite at 300 kHz is approximately 5 mm (with a 3000 micro-ohm-cm resistivity). Copper by comparison has a skin depth of about 0.12 mm. This 20:1 ratio is also advantageous is forcing the majority of power to be dissipated in the graphite foam.

The wall thickness of a graphite foam can in one example be between about 50-100 microns. The wall thickness will depend on the actual foam structure. The effective depth of penetration of the foam can therefore in one example be up to 110 mm using AC Induction heating.

In addition, internal surfaces that absorb energy may radiate the heat, but it is absorbed by the cell, so effectively there is total internal absorption of the heat. The surface of the foam will radiate heat outward, and this will cause losses due to radiation. There will be convection losses also, and both of these energy transfers are to heat fluids or other objects, or to radiate energy for observation.

Figure 19:
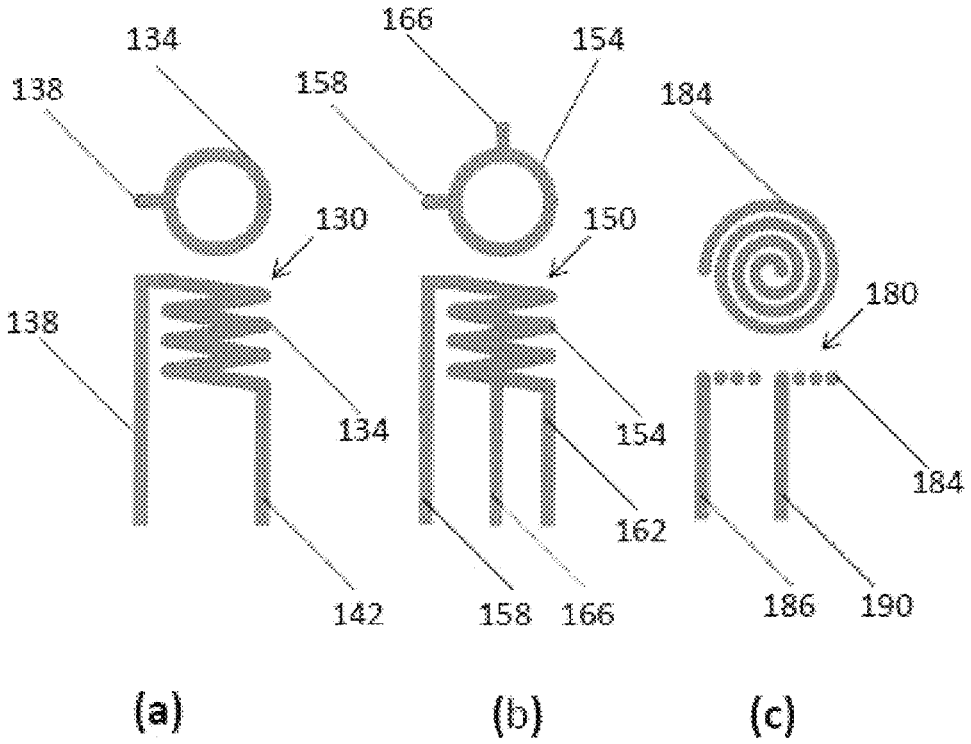
FIGS. 19(*a-c*) are plan and side elevations of several embodiments of coil constructions as related to heating a volume of graphite foam.
Figure 20:
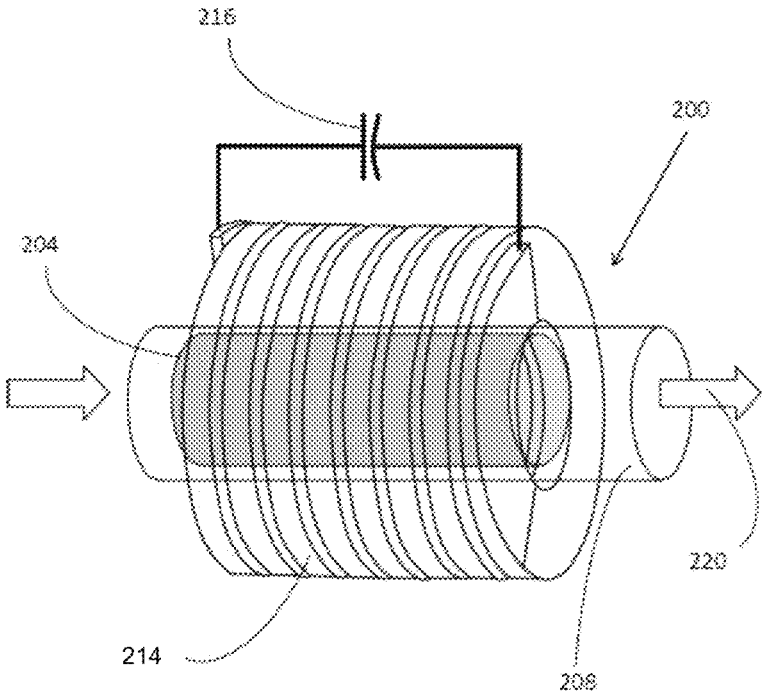
FIG. 20 is a schematic diagram of an alternative apparatus for heating a fluid.

The illustration in FIG. 19 contains three coil designs: (a) single layer two terminal solenoidal wound induction heating coil (typical 3 to 8 turns), (b) single layer center-tapped solenoidal wound induction coil (typical 3 to 8 turns), and (c) single layer spiral wound induction heating coil (typical 3 to 8 turns) (eg., pancake). The single layer induction coil 130 has coil turns 134 and terminals 138 and 142. The single layer center-tapped induction coil 150 has turns 154 and terminals 158 and 162, and a center tap 166. The single layer induction coil 180 has a single layer coil 184 and terminals 186 and 190. The coil sizes for a liquid or gas heating system can range from 0.75 to 3 inch inside diameter. The spiral design may range from 1.125 to 3 inches. Smaller as well as larger diameters are feasible and may be deployed depending of the amount of heat energy desired and the flow rate. An upper limit of several inches may be feasible. The center-tapped coil is useful for push-pull drivers. The push-pull drivers have an advantage that lower drive voltages are possible to achieve significant tank circuit currents. Coils may be geometrically modified from those shown. For example, the spiral coil can be made to conform to the curvature or diameter of the fluid flow chamber inside which the graphite foam heating element is housed. Coil wire diameter can range from 14 AWG to 4 AWG. Smaller gauges may be feasible for lower power systems. Likewise, larger wire gauges can be used for power designs of up to several hundred watts to several kilowatts. Round or square tubing (fabricated from soft copper refrigeration tubing) may be used. A significant efficiency advantage may be realizable by utilizing litz wire, in which several hundred individually insulated strands of copper wire are bundled to permit the entire cross section of wire to be conductive (the skin effect is applied to each individual strand rather than the whole solid copper cross section). Another coil design embodiment is to wind the coil from high aspect-ratio copper (width to thickness ratios greater than 20:1.) For example, a copper strip may be 200 to 400 microns thick and 8 mm wide; the coil would be wound flat. Other dimensions are possible. An example apparatus 200 is illustrated in FIG. 20 in which the graphite-heating element 204 is contained within the fluid flow in the tube 208, which is housed in the magnet bore 214 having a circuit with capacitor 216. Flow 220 through the tube 208 contacts heated graphite 204 to heat the fluid. This type of flat winding is similar to the Bitter magnets used at the National High Magnetic Field Laboratory (Florida State University, USA) and the High Field Magnet Laboratory at Radboud University in Nijmegan, Holland.

Figure 21:
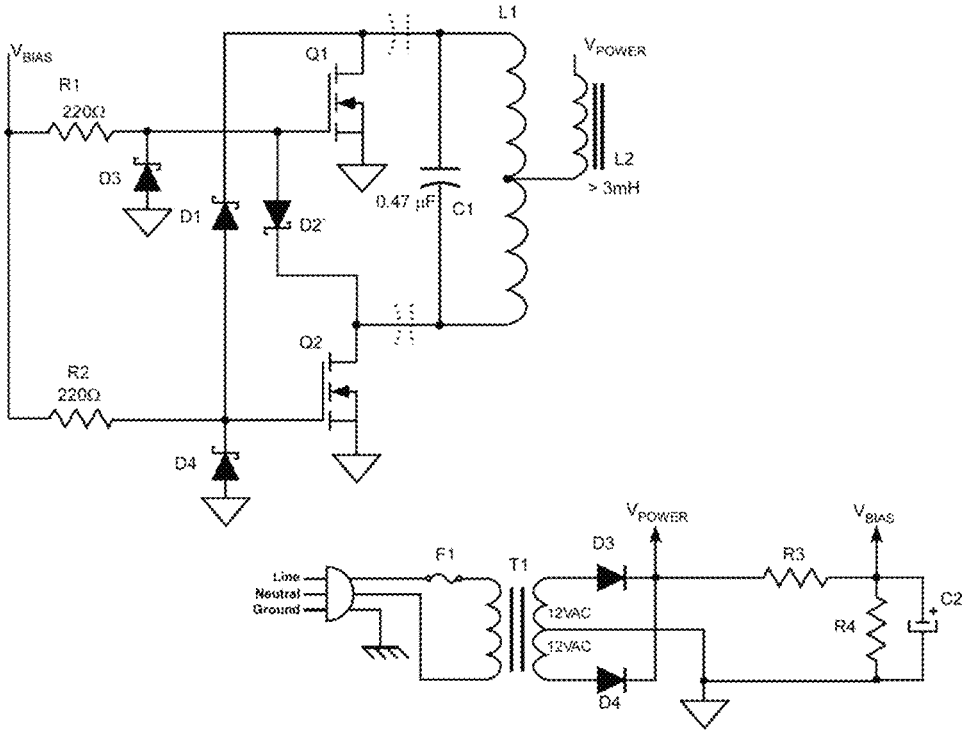
FIG. 21 is an illustrative electrical schematic diagram of a self-oscillating induction coil driver using a center-tapped induction coil.

Driving a roughly one cubic cm volume of graphite foam to about 700° C. has been accomplished using a 4-turn coil of ⅛ inch refrigeration tubing having less than 60 amps of 330 kHz coil current using a drive circuit similar to that of FIG. 21.

The concept of induction heating drive is to provide high currents to a coil at a desired frequency that is selected primarily by choosing the desired skin depth in a material. For graphite foam of several cm thickness, a frequency of 100 kHz to 400 kHz is a reasonable range. About 200 kHz is the upper operating frequency of insulated gate bipolar junction transistors (IGBTs). Metal Oxide Field Effect transistors (MOSFETs) are better suited to frequencies above 200 kHz. Several oscillator-driver circuit topologies are possible for driving the graphite foam emitter. FIG. 21 illustrates a push-pull MOSFET driver that is self-oscillating. The circuit as shown can operate on low voltage (12-20 VDC) with a frequency in the range of 300 kHz (depending on coil inductance). Other frequencies are possible and operation at higher voltages (above 200 volts) is feasible by increasing coil inductance and reducing parallel capacitance; such a change lowers the circulating current but maintains the amp-turns ratio. The capacitors shown as dotted are optional—they prevent catastrophic failure in case of a shorted transistor or failure to start oscillation. The circuit of FIG. 21 is a variation of the 1954 Royer oscillator originally realized with vacuum tubes. The circuit is somewhat inefficient because the MOSFETs are operating in either class A, AB, or B range (depending on bias level) and therefore have linear response during part of the cycle, which leads to dissipative transistor loss ($I^2R$ heating). DIAC or other bi-directional trigger diode type devices can be added to the gate drive of the circuit to delay turn-on of the drive elements (MOSFETS or IGBTs) so that they operate more like switches (as described below) and therefore less power is dissipated in the drive elements.

Figure 22:
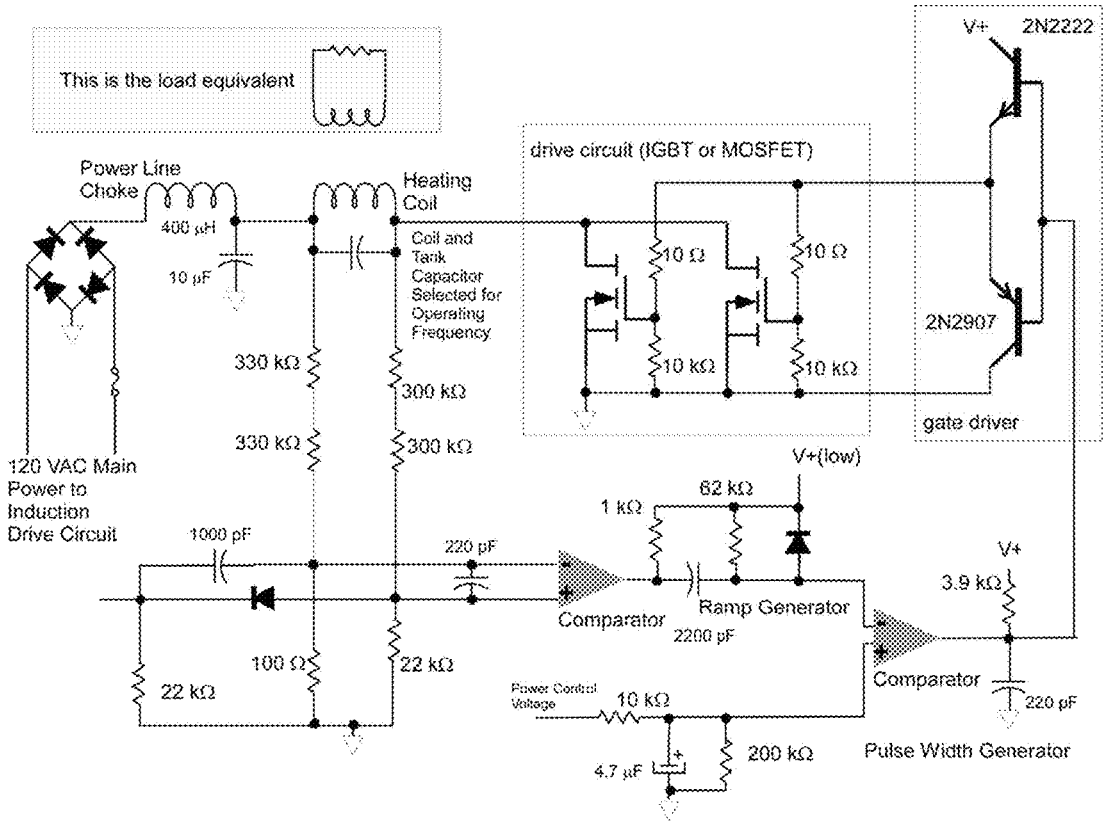
FIG. 22 is an illustrative electrical schematic diagram depicting a high efficiency induction coil drive circuit with drive power that is also continuously controllable by an input voltage.

Another circuit that can be applied to graphite foam heating and heating is the simplified single-ended driver circuit of FIG. 22. This circuit uses switch action comparators to force the MOSFETs into switching action rather than linear conduction. The heat dissipation in the transistors comes from $I^2R$ heating from residual resistance in the full on state and some small amount of linear action since the transistors are not infinitely fast. The circuit shows two MOSFETs, which may not be required for heating less than 100 watts. It is also possible that more parallel devices can be used for multi-kilowatt heating applications.

The apparatus can include a sensor for sensing an energy output from at least one of the graphite foam and the energy conversion device. A feedback control circuit can control the exposure of the time varying electromagnetic field based upon the sensed energy output. This control can be achieved by any suitable method, such as varying the current flow through the coil, varying the position of the coil relative to the graphite foam through a feedback-driven positioning drive motor, or other methods.

Figure 23:
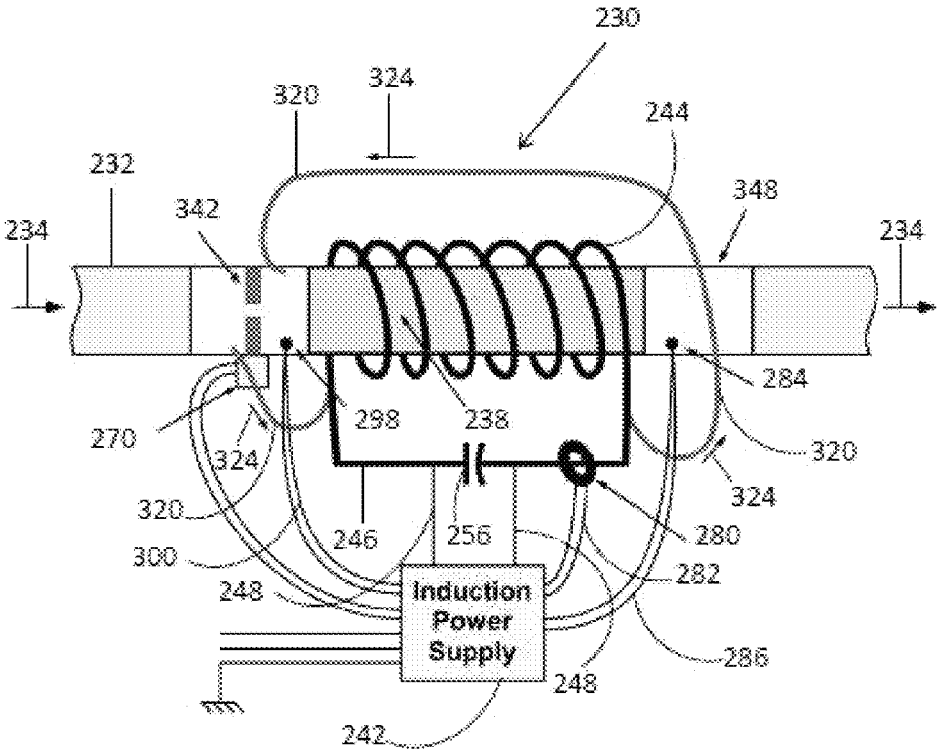
FIG. 23 is a schematic diagram of an apparatus for heating a fluid with closed loop feedback control.
Figure 24:
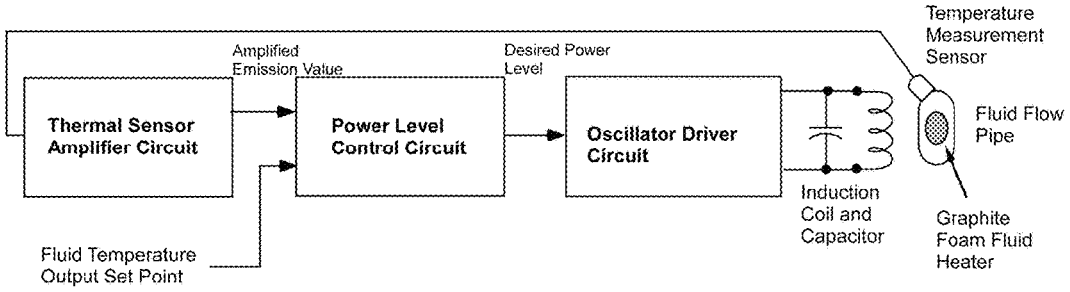
FIG. 24 is a block diagram of an apparatus for heating a fluid utilizing closed-loop feedback control.

The block diagram of FIG. 23 shows a system 230 to achieve closed-loop feedback control of the heat emission from graphite foam 238. The illustration shows water 234 entering a heating zone through tube 232 in which graphite foam 238 is the heating element. A coil 244 surrounds an electrically insulated section 348 (e.g., ceramic or high-temperature plastic). Fluid flow 234 is measured and turns on the induction power supply 242 which supplies coil 244 and circuit 246 through power supply connections 248. A capacitor 256 can be provided in circuit 246. A temperature sensor 284 is used to measure exit water temperature and provides this signal to the induction power supply 242 through signal communications channel 286, which can be wired or wireless. An upstream temperature sensor 298 can be provided and send a signal through signal channel 300. The sensor can be a thermistor, thermopile, thermocouple, solid-state sensor or an RTD. A fluid temperature sensor 270 can be provided and send signal through a suitable link 272. A coil current sensor 280 can provide a signal to induction power supply 242 through communications link 282. All sensor control signals directed to the induction power supply 242 can be processed by a suitable processor associated with the induction power supply 242. A coil cooling fluid channel 320 can be provided to circulate cooling fluid in the direction of arrow 324. A flow restriction 342 can be provided. FIG. 24 illustrates feedback control of the induction supply output in block diagram format.

The sensor signal is amplified to a voltage level sufficient to signal a control circuit in which the sensor signal is compared with a reference signal (the desired output level) and an error signal is developed. The error signal, being dynamic, is treated with further amplification including the action of integration and differentiation to produce a drive signal to the oscillator-coil-driver block (typically called proportional integral derivative, PID control). Other mathematical treatments of the sensor signal are possible including optimal control, model based control, fuzzy logic, and neural networks. However, as a low-cost alternative that will meet the needs of most heating applications, the proportional-integral method of feedback control will be sufficient.

One of the benefits of feedback control implemented in this manner is that all manufactured heating devices will have consistent output independent of manufacturing differences in the graphite foam, induction coil, as well as the applied line voltage, which can vary.

Power output of the driver circuits can be controlled by varying the amplitude of the voltage applied to the coil-capacitor tank circuit (and hence the circulating current) or by varying the timing of when the tank circuit is kicked by the drive transistors. These control methods can be accomplished in an analog implementation (i.e., continuously varying) or by entirely gating the power supply on and off with a duty cycle. For the example driver circuit of FIG. 21, either or both control methods of continuous or duty cycle can be applied:

1. Adjust applied voltage ($V_{power}$) in FIG. 21
2. Adjust bias voltage ($V_{bias}$) in FIG. 21
3. Duty cycle modulate the applied voltage ($V_{power}$) in FIG. 21
4. Duty cycle modulate bias voltage ($V_{bias}$) in FIG. 21

Similarly, for the example driver circuit of FIG. 22, either or both control methods can be applied:

1. Adjust power control voltage in FIG. 22
2. Duty cycle modulate power control voltage in FIG. 22

These adjustment and/or duty cycle modulation controls are accomplished to set the heat output of the graphite foam to a specific value. As described previously, these controls can be derived by a comparison of the measured heat emission from the sensor indicated in FIG. 24 with a pre-established reference value. Because of the time constant associated with heating the graphite foam (several tens of seconds to minutes), off-on modulation can be applied in the time range from fractions of a second (e.g., 0.01 s) to several seconds (up to ten seconds). The long thermal time constant of the graphite foam integrates the power so that no appreciable fluctuation of the emitted output is detectable. Long time constants would be more associated with very high power output application of many kilowatts.

Heat from the surrounding environment including incoming fluid temperature can be measured by a separate sensor (not the sensor described above) to augment the required amount of heat output as a function of ambient conditions. The ambient sensor would be used to adjust the reference output power up or down to accommodate the ambient heat. In addition to the ambient heat adjustment, other (exogenous) inputs can be accepted to the system to modify its output thus accommodating local conditions.

EXAMPLE

Process of Making the Foam

Any suitable method of making the foam can be utilized. A process of producing a suitable carbon foam can include selecting an appropriate mold shape. Pitch is introduced into the mold to an appropriate level. Air is purged from the mold. The pitch is heated to a temperature sufficient to coalesce the pitch into a liquid. An inert fluid at a static pressure of up to about 1000 psi is applied to the pitch. The pitch is heated to a temperature sufficient to cause gases to evolve and foam the pitch. The pitch is then heated to a temperature sufficient to coke the pitch. The foam is cooled to room temperature with a simultaneous release of pressure to produce a carbon foam.

Heating the carbon foam to temperatures high enough to convert the structure within the ligaments and cell walls to graphite.

Pitch powder, granules, or pellets are placed in a mold with the desired final shape of the foam. These pitch materials can be solvated if desired. In this Example Mitsubishi ARA-24 mesophase pitch was utilized. A proper mold release agent or film is applied to the sides of the mold to allow removal of the part. In this case, boron nitride spray and dry graphite lubricant were separately used as a mold release agent. If the mold is made from pure aluminum, no mold release agent is necessary since the molten pitch does not wet the aluminum and, thus, will not stick to the mold. Similar mold materials may be found that the pitch does not wet and, thus, they will not need mold release. The sample is evacuated to less than 1 torr and then heated to a temperature approximately 50 to 100° C. above the softening point. In this case where Mitsubishi ARA24 mesophase pitch was used, 300° C. was sufficient. At this point, the vacuum is released to a nitrogen blanket and then a pressure of up to 1000 psi is applied. The temperature of the system is then raised to 800° C., or a temperature sufficient to coke the pitch which is 500° C. to 1000° C. This is performed at a rate of no greater than 5° C./min. and preferably at about 20° C./min. The temperature is held for at least 15 minutes to achieve an assured soak and then the furnace power is turned off and cooled to room temperature. Preferably the foam was cooled at a rate of approximately 1.5° C./min. with release of pressure at a rate of approximately 2 psi/min. Final foam temperatures for three product runs were 500° C., 630° C. and 800° C. During the cooling cycle, pressure is released gradually to atmospheric conditions. The foam was then heat treated to 1050° C. (carbonized) under a nitrogen blanket and then heat treated in separate runs to 2500° C. and 2800° C. (graphitized) in Argon.

Figure 25:
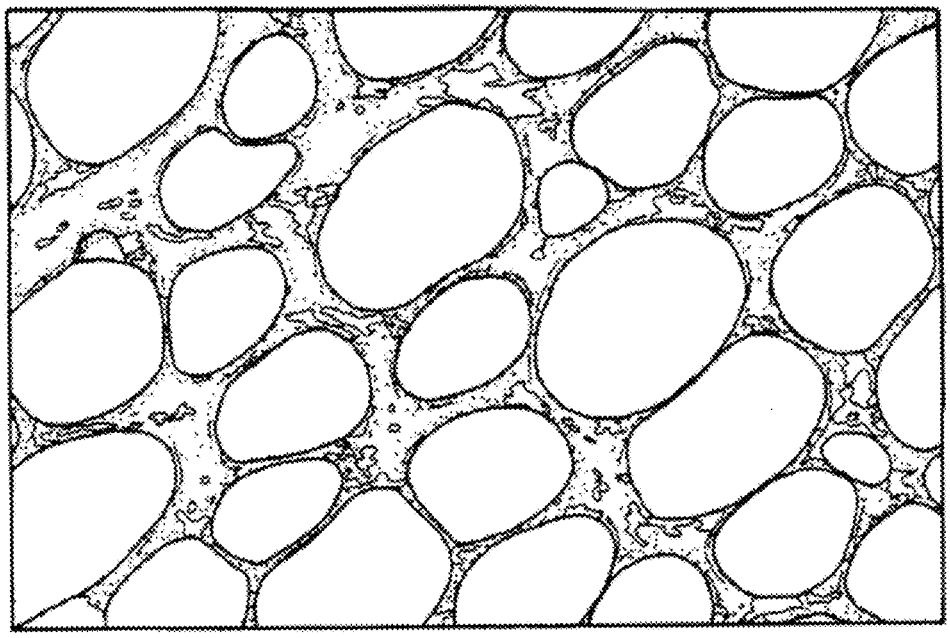
FIG. 25 is diagram of graphitic foam suitable for use with the invention.

Carbon foam produced with this technique was examined with photomicrography, scanning electron microscopy (SEM), X-ray analysis, and mercury porisimetry. The interference patterns under cross-polarized light indicated that the struts of the foam are completely graphitic. That is, all of the pitch was converted to graphite and aligned along the axis of the struts. These struts are also similar in size and are interconnected throughout the foam. The foam therefore has high stiffness and good strength. As seen in FIG. 25 the foam is open cellular meaning that the porosity is not closed. Mercury porisimetry indicated that the pore sizes are in the range of 90-200 microns.

A thermogravimetric study of the raw pitch was performed to determine the temperature at which the volatiles are evolved. The pitch loses nearly 20% of its mass fairly rapidly in the temperature range between about 420° C. and about 480° C. Although this was performed at atmospheric pressure, the addition of 1000 psi pressure will not shift this effect significantly. Therefore, while the pressure is at 1000 psi, gases rapidly evolved during heating through the temperature range of 420° C. to 480° C. The gases produce a foaming effect (like boiling) on the molten pitch. As the temperature is increased further to temperatures ranging from 500° C. to 1000° C. (depending on the specific pitch), the foamed pitch becomes coked (or rigid), thus producing a solid foam derived from pitch. Hence, the foaming occurs before the release of pressure. Heating the pitch in a similar manner, but under only atmospheric pressure, causes the pitch to foam significantly more than when it is heated under pressure. The resulting foam is so fragile that it could not even be handled to perform tests.

Samples from the foam were machined into specimens for measuring the thermal conductivity. The bulk thermal conductivity ranged from 58 W/m·K to 106 W/m·K. The average density of the samples was 0.53 g/cm$^3$. When weight is taken into account, the specific thermal conductivity of the pitch derived foam is over 4 times greater than that of copper. The specific thermal conductivity of the graphite foam is at least 109 W cm$^3$/mKg. The specific thermal conductivity of the graphite foam can be between 109-200 W cm$^3$/mKg. Further derivations can be utilized to estimate the thermal conductivity of the struts themselves to be nearly 700 W/m·K. This is comparable to high thermal conductivity carbon fibers produced from this same ARA24 mesophase pitch.

Figure 26:
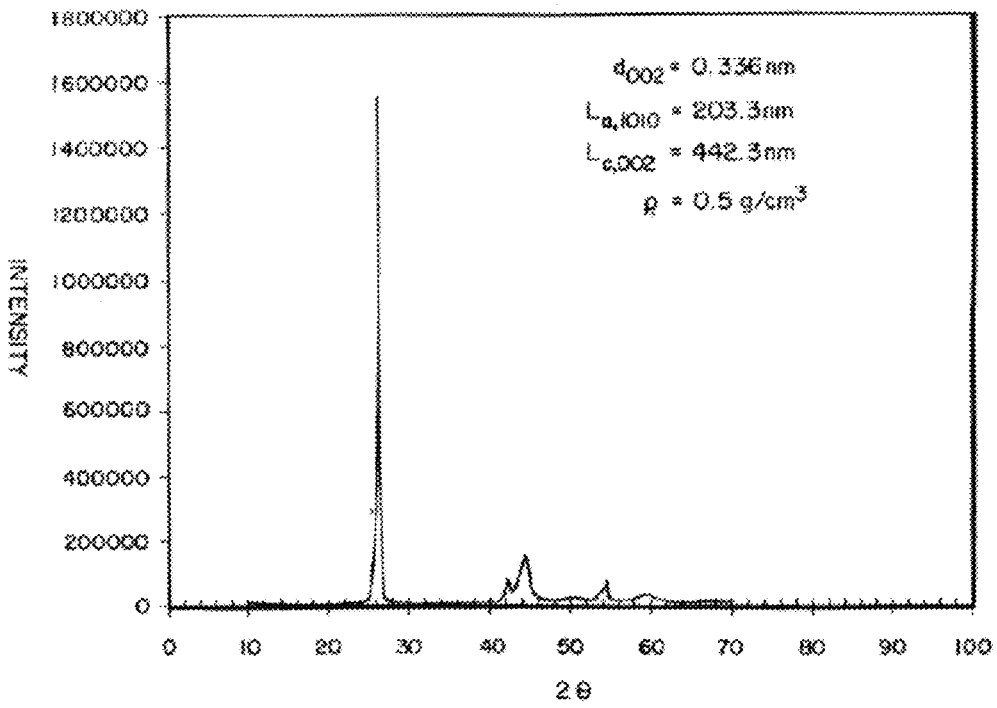
FIG. 26 is an X-ray analysis of graphitic foam used in the invention.

X-ray analysis of the foam was performed to determine the crystalline structure of the material. The results are shown in FIG. 26. From this data, the graphene layer spacing ($d_{002}$) was determined to be 0.336 nm. The coherence length (La, 1010) was determined to be 203.3 nm and the stacking height was determined to be 442.3 nm. The graphite foam can have an X-ray diffraction pattern exhibiting doublet peaks at 2θ angles between 40 and 50 degrees.

The compression strength of the samples was measured to be 3.4 MPa and the compression modulus was measured to be 73.4 MPa. The foam sample was easily machined and could be handled readily without fear of damage, indicating a good strength.

Examples will show the diversity of graphite foams that are suitable for the invention.

Foam Example 1

Density—0.55 g/cc
Thermal Conductivity—80-100 W/mK
Porosity—75%
Starting Material: Koppers L1 Mesophase Pitch Foam Example 2

Density—0.7 g/cc
Thermal Conductivity 220-240 W/mK
Porosity—69%
Starting Material: Koppers P1 Mesophase Pitch Foam Example 1 will produce a foam with higher porosity, more suitable for flowing a fluid through the foam to heat the fluid. Foam Example 2 will produce a foam with more closed porosity, and suitable for heating an object by radiation, conduction, or flowing a fluid over the outside of the structure. This will have high pressure drop if a fluid is attempted to flow through the pores of the foam.

Ranges: throughout this disclosure, various aspects of the invention can be presented in a range format. It should be understood that the description in the range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range for example, 1, 2, 2.7, 3, 4, 5, 5.3 and 6. This applies regardless of the bread of the range.

This invention can be embodied in other forms without departing from the spirit or essential attributes thereof, and accordingly, reference should be had to the following claims to determine the scope of the invention.

We claim:

1. A magneto-energy apparatus for heating a fluid, comprising:

an electromagnetic field generating device for generating a time-varying electromagnetic field of between 180 kHz and 10 MHz;

a porous graphite foam conductor disposed within the electromagnetic field, the porous graphite foam conductor comprising a plurality of pores including subsurface portions that are interconnected so as to permit fluid flow there through, the pores defined by pore walls having a wall thickness of from 50 μm to 100 μm and the porous graphite foam conductor having a porosity of from 67% to 89%;

the porous graphite foam conductor when exposed to the time-varying electromagnetic field conducting an induced electric current, the electric current heating the porous graphite foam conductor;

an energy conversion device utilizing heat energy from the porous graphite foam conductor to perform a heat energy consuming function on the fluid, by contacting the fluid to the porous graphite foam conductor including subsurface pore wall portions of the porous graphite foam conductor; and, a feedback control for controlling the electromagnetic field generating device according to a sensed characteristic of the fluid.

2. The magneto-energy apparatus of claim 1, wherein the porous graphite foam conductor has a thermal conductivity of at least 40 W/mK.

3. The magneto-energy apparatus of claim 1, wherein the porous graphite foam conductor has a thermal conductivity of between 40 W/mK and 100 W/mK.

4. The magneto-energy apparatus of claim 1, wherein the porous graphite foam conductor has a porosity of at least 75%.

5. The magneto-energy apparatus of claim 1, wherein the porous graphite foam conductor has a thermal conductivity of at least 220 W/mK.

6. The magneto-energy apparatus of claim 1, wherein the porous graphite foam conductor has a thermal conductivity of between 220 W/mK and 240 W/mK.

7. The magneto-energy apparatus of claim 1, wherein the porous graphite foam conductor has a porosity of at least 69%.

8. The magneto-energy apparatus of claim 1, wherein the porous graphite foam conductor has a porosity of between 69% to 85%.

9. The magneto-energy apparatus of claim 1, wherein the specific thermal conductivity of the porous graphite foam conductor is at least 109 W $cm^3$/mKg.

10. The magneto-energy apparatus of claim 1, wherein the specific thermal conductivity of the porous graphite foam conductor is between 109 W $cm^3$/mKg and 200 W $cm^3$/mKg.

11. The magneto-energy apparatus of claim 1, wherein the time varying electromagnetic field has a frequency of between 25 kHz and 1 MHz.

12. The magneto-energy apparatus of claim 1, wherein the time varying electromagnetic field has a power of at least 1 kW.

13. The magneto-energy apparatus of claim 1, wherein the time varying electromagnetic field has a power of between 10 W and 20 kW.

14. The magneto-energy apparatus of claim 1, wherein the porous graphite foam conductor is derived from a pitch selected from the group consisting of petroleum-derived mesophase pitch, petroleum derived isotropic pitch, coal-tar-derived mesophase pitch, synthetic mesophase pitch, and synthetic isotropic pitch.

15. The magneto-energy apparatus of claim 1, wherein the porous graphite foam conductor has an X-ray diffraction pattern as depicted in FIG. 26.

16. The magneto-energy apparatus of claim 1, wherein the porous graphite foam conductor has a specific thermal conductivity greater than four times that of copper.

17. The magneto-energy apparatus of claim 1, wherein the porous graphite foam conductor has an X-ray diffraction pattern exhibiting doublet peaks at 2θ angles between 40 degrees and 50 degrees.

18. The magneto-energy apparatus of claim 1, wherein the energy conversion device is a water heater.

19. The magneto-energy apparatus of claim 1, wherein the porous graphite foam conductor is within an electrically non-conductive housing.

20. The magneto-energy apparatus of claim 1, wherein the fluid flows through a fluid flow path, and the graphite foam conductor is positioned in the fluid flow path such that all of the flowing fluid flows through the interconnected pores the graphite foam conductor.

21. A device for heating a fluid, comprising:

an electromagnetic field generating device for generating a time-varying electromagnetic field of between 180 kHz and 10 MHz;

a porous graphite foam conductor disposed within the electromagnetic field, the porous graphite foam conductor comprising a plurality of pores including subsurface portions that are interconnected so as to permit fluid flow there through, the pores defined by pore walls having a wall thickness of from 50 μm to 100 μm and the porous graphite foam conductor having a porosity of from 67% to 89%, the porous graphite foam conductor when exposed to the time-varying electromagnetic field conducting an induced electric current, the electric current heating the porous graphite foam conductor including subsurface pore wall portions;

at least one fluid flow path for contacting the fluid with the porous graphite foam conductor including subsurface pore wall portions of the porous graphite foam conductor, whereby the porous graphite foam conductor will transfer heat to the fluid; and a feedback control for controlling the electromagnetic field generating device according to a sensed characteristic of the fluid.

22. The device of claim 21, wherein the fluid is water.

23. The device of claim 21, further comprising a switch for selectively energizing the electromagnetic field source.

24. The device of claim 21, further comprising at least one temperature sensor, the temperature sensor operating to turn on the electromagnetic field source when the temperature of the fluid is below a set point, and to turn off the electromagnetic field source when the temperature of the fluid is above a set point.

25. The device of claim 21, wherein the fluid flows through a fluid flow path, and the graphite foam conductor is positioned in the fluid flow path such that all of the flowing fluid flows through the interconnected pores the graphite foam conductor.

26. A method of converting energy and imparting at least a portion of that energy to a fluid, comprising the steps of:

providing an electromagnetic field generating device for generating a time-varying electromagnetic field of between 180 kHz and 10 MHz;

providing a porous graphite foam conductor disposed within the electromagnetic field, the porous graphite foam conductor comprising a plurality of pores including subsurface portions that are interconnected so as to permit fluid flow there through, the pores defined by pore walls having a wall thickness of from 50 μm to 100 μm and the porous graphite foam conductor having a porosity of from 67% to 89%, the porous graphite foam conductor when exposed to the time-varying electromagnetic field conducting an induced electric current, the electric current heating the porous graphite foam conductor including subsurface pore wall portions;

providing an energy conversion device and utilizing heat energy from the heated porous graphite foam conductor to perform a heat energy consuming function on the fluid by contacting the fluid to the porous graphite foam conductor including subsurface pore wall portions of the porous graphite foam conductor; and, providing feedback control for controlling the electromagnetic field generating device according to a sensed characteristic of the fluid.

27. The method of claim 26, wherein the energy conversion step is heating a substance.

28. The method of claim 26, wherein the fluid is water.

29. The method of claim 26, wherein the porous graphite foam conductor is heated between 600° C. and 1000° C. in 15 seconds.

30. The method of claim 26, wherein the fluid flows through a fluid flow path, and the graphite foam conductor is positioned in the fluid flow path such that all of the flowing fluid flows through the interconnected pores the graphite foam conductor.

* * * * *